US006644422B1

(12) United States Patent
Rial et al.

(10) Patent No.: US 6,644,422 B1
(45) **Date of Patent: *Nov. 11, 2003**

(54) PANTOGRAPH UNDERREAMER

(75) Inventors: Monty H. Rial, Dallas, TX (US); Lawrence W. Diamond, Rockwall, TX (US); Harold E. Payne, Spring, TX (US)

(73) Assignee: CDX Gas, L.L.C., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/929,175

(22) Filed: Aug. 13, 2001

(51) Int. Cl.[7] ..... E21B 7/28

(52) U.S. Cl. ..... 175/57; 175/285

(58) Field of Search ..... 175/285, 284, 175/272, 289, 57

(56) References Cited

U.S. PATENT DOCUMENTS

| | | | | | |
|---|---|---|---|---|---|
| 54,144 | A | | 4/1866 | Hamar | 175/263 |
| 274,740 | A | | 3/1883 | Douglass | |
| 639,036 | A | | 12/1899 | Heald | 175/263 |
| 1,189,560 | A | | 7/1916 | Gondos | 175/265 |
| 1,285,347 | A | | 11/1918 | Otto | 175/263 |
| 1,317,192 | A | * | 9/1919 | Jones | 175/202 |
| 1,467,480 | A | | 9/1923 | Hogue | 175/263 |
| 1,485,615 | A | | 3/1924 | Jones | 175/263 |
| 1,498,463 | A | * | 6/1924 | McCloskey et al. | 175/173 |
| 1,674,392 | A | | 6/1928 | Flansburg | |
| 1,970,063 | A | * | 8/1934 | Steinman | 175/202 |
| 2,018,285 | A | | 10/1935 | Schweitzer et al. | 166/21 |
| 2,031,353 | A | * | 2/1936 | Woodruff | 175/285 |
| 2,069,482 | A | | 2/1937 | Seay | 255/76 |
| 2,150,228 | A | | 3/1939 | Lamb | 166/10 |
| 2,169,502 | A | * | 8/1939 | Santiago | 175/268 |
| 2,169,718 | A | | 8/1939 | Böll et al. | 255/24 |
| 2,450,223 | A | | 9/1948 | Barbour | 255/76 |
| 2,490,350 | A | | 12/1949 | Grable | 166/4 |
| 2,679,903 | A | | 6/1954 | McGowen, Jr. et al. | 166/1 |
| 2,847,189 | A | | 8/1958 | Shook | 255/76 |
| 3,379,266 | A | * | 4/1968 | Fletcher | 175/285 |
| 3,397,750 | A | * | 8/1968 | Wicklund | 175/18 |
| 3,443,648 | A | | 5/1969 | Howard | 175/103 |
| 3,528,516 | A | | 9/1970 | Brown | 175/207 |
| 3,684,041 | A | | 8/1972 | Kammerer, Jr. et al. | 175/267 |
| 3,757,876 | A | | 9/1973 | Pereau | 175/267 |
| 3,757,877 | A | | 9/1973 | Leathers | 175/269 |
| 4,073,351 | A | | 2/1978 | Baum | 175/14 |
| 4,169,510 | A | | 10/1979 | Meigs | 175/65 |
| 4,189,184 | A | | 2/1980 | Green | 299/8 |
| 4,278,137 | A | | 7/1981 | Van Eek | 175/267 |
| 4,323,129 | A | * | 4/1982 | Cordes | 175/173 |
| 4,366,988 | A | | 1/1983 | Bodine | 299/14 |
| 4,396,076 | A | | 8/1983 | Inoue | 175/265 |
| 4,401,171 | A | | 8/1983 | Fuchs | 175/267 |
| 4,407,376 | A | | 10/1983 | Inoue | 175/267 |

(List continued on next page.)

OTHER PUBLICATIONS

Pend Pat App, Monty H. Rial et al., "*Pantograph Underreamer*, " SN 09/929,551 (067083.0126) Filed Aug. 13, 2001.

(List continued on next page.)

*Primary Examiner*—Hoang Dang
(74) *Attorney, Agent, or Firm*—Baker Botts L.L.P.

(57) ABSTRACT

An underreamer for forming a cavity within a well bore is provided. The underreamer may include a housing rotatably disposed within the well bore. The underreamer may also include an actuation rod slidably positioned in the housing. The underreamer may further include a plurality of cutter sets where each cutter set is pivotally coupled to the housing and the actuation rod. The cutter sets are also pivotally coupled together. An axial force applied to the actuation rod operates to slide the actuation rod relative to the housing and extend the cutter sets from a retracted position radially outward relative to the housing to form the cavity when the housing is rotated.

21 Claims, 3 Drawing Sheets

U.S. PATENT DOCUMENTS

| | | | | |
|---|---|---|---|---|
| 4,494,616 | A | 1/1985 | McKee | 175/67 |
| 4,558,744 | A | 12/1985 | Gibb | 166/335 |
| 4,565,252 | A | 1/1986 | Campbell et al. | 175/269 |
| 4,618,009 | A | 10/1986 | Carter et al. | 175/267 |
| 4,674,579 | A | 6/1987 | Geller et al. | 175/45 |
| 4,715,440 | A | 12/1987 | Boxell et al. | 166/100 |
| 4,830,105 | A | 5/1989 | Petermann | 166/241 |
| 5,036,921 | A | 8/1991 | Pittard et al. | 166/298 |
| 5,135,058 | A | 8/1992 | Millgard et al. | 175/71 |
| 5,148,875 | A | 9/1992 | Karlsson et al. | 175/62 |
| 5,201,817 | A | 4/1993 | Hailey | 175/269 |
| 5,242,017 | A | 9/1993 | Hailey | 166/55.8 |
| 5,255,741 | A | 10/1993 | Alexander | 166/278 |
| 5,271,472 | A | 12/1993 | Leturno | 175/107 |
| 5,363,927 | A | 11/1994 | Frank | 175/67 |
| 5,385,205 | A | 1/1995 | Hailey | 166/55.8 |
| 5,402,856 | A | 4/1995 | Warren et al. | 175/57 |
| 5,494,121 | A | 2/1996 | Nackerud | 175/263 |
| 5,499,687 | A | 3/1996 | Lee | 175/317 |
| 5,722,489 | A | 3/1998 | Lambe et al. | 166/269 |
| 5,853,054 | A | 12/1998 | McGarian et al. | 175/267 |
| 6,070,677 | A * | 6/2000 | Johnston, Jr. | 166/174 |
| 6,227,312 | B1 | 5/2001 | Eppink | 175/57 |
| 6,378,626 | B1 | 4/2002 | Wallace | 175/19 |

OTHER PUBLICATIONS

Pend Pat App, Monty H. Rial et al., "*Pantograph Underreamer*, " SN 09/929,568 (067083.0145), Filed Aug. 13, 2001.

Pend Pat App, Lawrence W. Diamond et al., "*Single–BladeUnderreamer*," SN 09/932,482 (067083.0125), Filed Aug. 17, 2001.

Pend Pat App, Lawrence W. Diamond et al., "*Multi–Blade-Underreamer*," SN 09/932,487 (067083.0136), Aug. 17, 2001.

Pend Pat App, Monty H. Rial et al., "*Pantograph Underreamer*," SN 10/079,444 (067083.0143), Feb. 19, 2002.

Nackerud Product Description, Rec'd Sep. 27, 2001.

* cited by examiner

PANTOGRAPH UNDERREAMER

RELATED APPLICATIONS

This application is related to Application Ser. No. 09/929,551, entitled "Pantograph Underreamer," filed on Aug. 13, 2001; and application Ser. No. 09/929,568, entitled "Pantograph Underreamer," filed on Aug. 13, 2001.

TECHNICAL FIELD OF THE INVENTION

This invention relates in general to the field of subterranean exploration and, more particularly, to a pantograph underreamer.

BACKGROUND OF THE INVENTION

Underreamers are generally used to form an enlarged cavity in a well bore extending through a subterranean formation. The cavity may then be used to collect resources for transport to the surface, as a sump for the collection of well bore formation cuttings and the like, or for other suitable subterranean exploration and resource production operations. Additionally, the cavity may be used in well bore drilling operations to provide an enlarged target for constructing multiple intersecting well bores.

One example of an underreamer includes a plurality of cutting blades pivotally coupled to a lower end of a drill pipe. Centrifugal forces caused by rotation of the drill pipe extend the cutting blades outward and diametrically opposed to each other. As the cutting blades extend outward, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outward at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

Accordingly, a need has arisen for an improved underreamer that provides increased control of subterranean cavity formation. The present invention provides a pantograph underreamer that addresses shortcomings of prior underreamers.

According to one embodiment of the present invention, an underreamer for forming a cavity within a well bore includes a housing rotatably disposed within the well bore. The underreamer also includes an actuation rod slidably positioned in coupled to the housing. The underreamer further includes a plurality of cutter sets each having a first end pivotally coupled to the housing and a second end pivotally coupled to the actuation rod. The cutter sets are also pivotally coupled together. An axial force applied to the actuation rod is operable to slide the actuation rod relative to the housing and extend the cutter sets radially outward relative to the housing from a retracted position to form the cavity when the housing is rotated.

According to another embodiment of the present invention, a method for forming a cavity within a well bore includes positioning an underreamer within the well bore. The underreamer includes a housing and an actuation rod. The actuation rod is slidably positioned in the housing. The underreamer further includes a plurality of cutter sets where each cutter set includes a first end coupled to the housing and a second end coupled to the actuation rod. The method further includes applying an axial force to the actuation rod and extending the cutter sets radially outward from a retracted position relative to the housing in response to movement of the actuation rod relative to the housing from the applied force. The method further includes rotating the underreamer within the well bore to form the cavity.

The invention provides several technical advantages. For example, according to one embodiment of the present invention, an axial force is applied to an actuation rod of the underreamer to cause outwardly directed movement of cutter sets into a subterranean formation. The axial force applied to the actuation rod may be varied to produce corresponding varying pressures on the formation by the cutter sets. Thus, the present invention may be used to accommodate a variety of formation densities and compositions. Additionally, decreased rotational speeds of the underreamer may be used to form the cavity, thereby substantially reducing or eliminating hazards associated with high speed rotating mechanisms.

Another technical advantage of the present invention includes substantially reducing or eliminating out-of-balance conditions resulting from rotation of the underreamer within a well bore. For example, according to one embodiment of the present invention, an end of each of the cutter sets is coupled to the actuation rod, thereby resulting in substantially uniform extension and increased precision of each of the cutter sets relative to the underreamer housing. Thus, out-of-balance conditions caused by varying positions of cutting blades are substantially reduced or eliminated.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Figure 1:
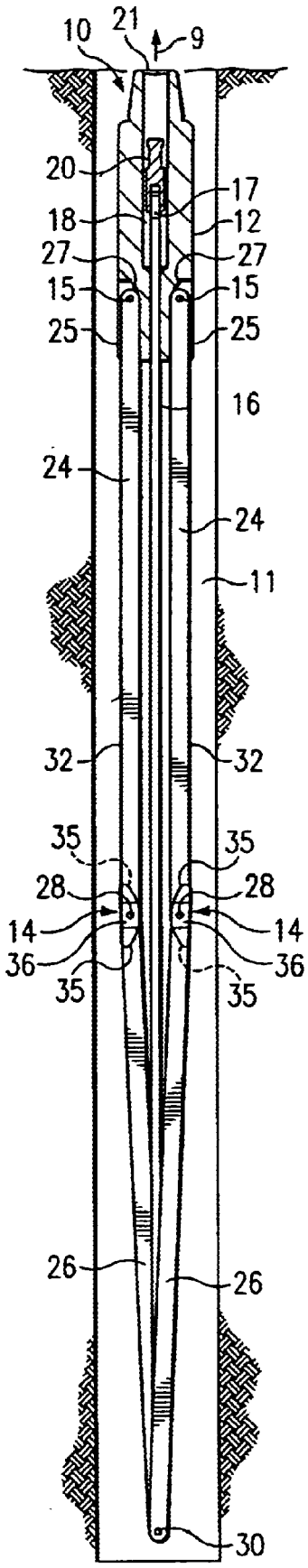
FIG. 1 is diagram illustrating a cross-section of a pantograph underreamer in accordance with an exemplary embodiment of the present invention.

FIG. 1 is a diagram illustrating a multi-blade underreamer 10 in accordance with an exemplary embodiment of the present invention. Underreamer 10 includes a housing 12 illustrated as being substantially vertically disposed within a well bore 11. However, it should be understood that underreamer 10 may also be used in non-vertical cavity forming operations. Underreamer 10 also includes a plurality of cutter sets 14 pivotally coupled to housing 12. FIG. 1 illustrates two cutter sets 14; however underreamer 10 may have more than two cutter sets 14, and having three or five cutter sets 14 may add stability to underreamer 10. In this embodiment, each of cutter sets 14 is pivotally coupled to the housing via a pin 15; however, other suitable methods may be used to provide pivotal or rotational movement of cutter sets 14 relative to housing 12.

Underreamer 10 also includes an actuation rod 16 slidably positioned within an internal passage 18 of housing 12. Actuation rod 16 includes a fishing neck 20 coupled to an end 17 of actuation rod 16. Housing 12 includes a recess 21 capable of receiving fishing neck 20 while underreamer 10 is in the retracted position. Fishing neck 20 is operable to engage a fishing tool (not expressly shown) lowered within well bore 11 to which an axial force is applied, which in turn slides actuation rod 16 relative to housing 12. The axial force is a force in a direction along the longitudinal axis of actuation rod 16. Such direction is illustrated in FIG. 1 by arrow 9. The fishing tool can be a 1 ½" jar down to shear tool; however, other suitable techniques may be used slide actuation rod 16 relative to housing 12.

Each cutter set 14 contains a first cutter 24 and a second cutter 26. It should be understood that the cross-sections of first cutters 24 and second cutters 26 may have various shapes and configurations. For example, first cutters 24 and second cutters 26 may have a round, hexagonal or any other shape as a cross-section. Furthermore, such cross-sectional shape and configuration may differ at different locations on first cutters 24 and second cutters 26. Each first cutter 24 is pivotally coupled to a respective second cutter 26. In this embodiment, each first cutter 24 is pivotally coupled to a second cutter 26 via a pin 28; however, other suitable methods may be used to provide pivotal or rotational movement of cutters 24 and 26 relative to one another.

The locations on each first cutter 24 and second cutter 26 where cutters 24 and 26 are coupled may be at a point that is not at the ends of first cutter 14 and/or second cutter 26. Coupling first and second cutters 24 and 26 at a location other than their ends can shield and protect pins 28 during rotation of underreamer 10 since pins 28 would not be in contact with exposed surfaces of well bore 11 during rotation. For example, tips 35 may extend approximately six to twelve inches, or any other distance, past pins 28 where first and second cutters 24 and 26 are coupled. Coupling first and second cutters 24 and 26 at such locations also allows for tips 35 of cutters 24 and 26 to absorb much of the wear and tear from contact with well bore 11. In particular embodiments, tips 35 may be replaced as they get worn down during rotation of underreamer 10 and may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation.

Second cutters 26 are each pivotally coupled to each other and actuation rod 16. In this embodiment, each of second cutters 26 is pivotally coupled to the other second cutters and actuation rod 16 via a pin 30; however, other suitable methods may be used to provide pivotal or rotational movement of second cutters 26.

In the illustrated embodiment, housing 12 also includes outwardly facing recesses 25, which are each adapted to receive a cutter set 14. Housing 12 may have a bevel 27 at each recess 25 in order to restrict and prevent too much rotational movement of first cutters 24 when actuation rod 16 moves in response to the axial force.

In the embodiment illustrated in FIG. 1, each of first cutters 24 and second cutters 26 comprises an outwardly disposed cutting surface 32 and an end cutting surface 36. Cutting surfaces 32 and 36 may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 32 and 36 configurations may be machined or formed on first cutters 24 or second cutters 26 to enhance the cutting characteristics of cutters 24 or 26.

Figure 2:
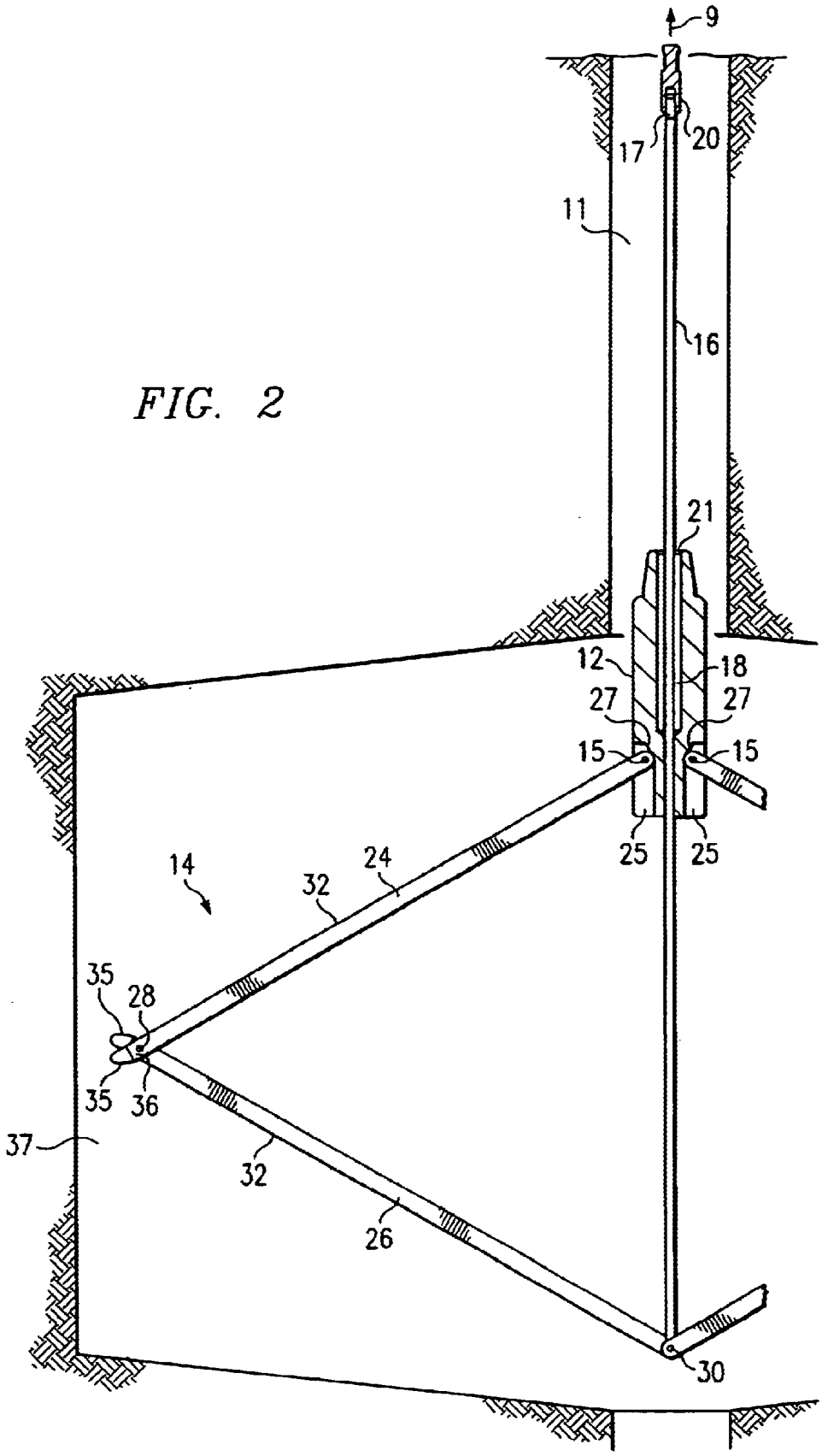
FIG. 2 is a diagram illustrating the pantograph underreamer illustrated in FIG. 1 in an extended position.

FIG. 2 is a diagram illustrating underreamer 10 illustrated in FIG. 1 having cutter sets 14 disposed in an extended position relative to housing 12. In FIG. 2, actuation rod 16 is illustrated in an upwardly disposed position relative to housing 12.

In response to movement of actuation rod 16 relative to housing 12, first cutters 24 rotate about pins 15 and second cutters 26 rotate about pins 30 extending cutter sets 14 radially outward relative to housing 12. Housing 12 is rotated within well bore 11 as cutter sets 14 extend radially outward relative to housing 12. Rotation of housing 12 may be achieved via a drill string attached to housing 12; however, other suitable methods of rotating housing 12 may be utilized. The drill string may also aid in stabilizing housing 12 in well bore 11. Through the rotation of housing 12 and extension of the cutter sets via the movement of actuation rod 16 relative to housing 12, underreamer 10 forms an enlarged cavity 37 as cutting surfaces 32 and 36 come into contact with the surfaces of well bore 11. Actuation rod 16 may be moved in the direction of arrow 9 as well as in the opposite direction using the fishing tool or other mechanism during rotation of housing 12 to further define cavity 37 being formed, and underreamer 10 may be moved in such directions to further define and shape cavity 37 within well bore 11. It should be understood that a subterranean cavity having a shape other than the shape of cavity 37 may be formed with underreamer 10.

Figure 3:
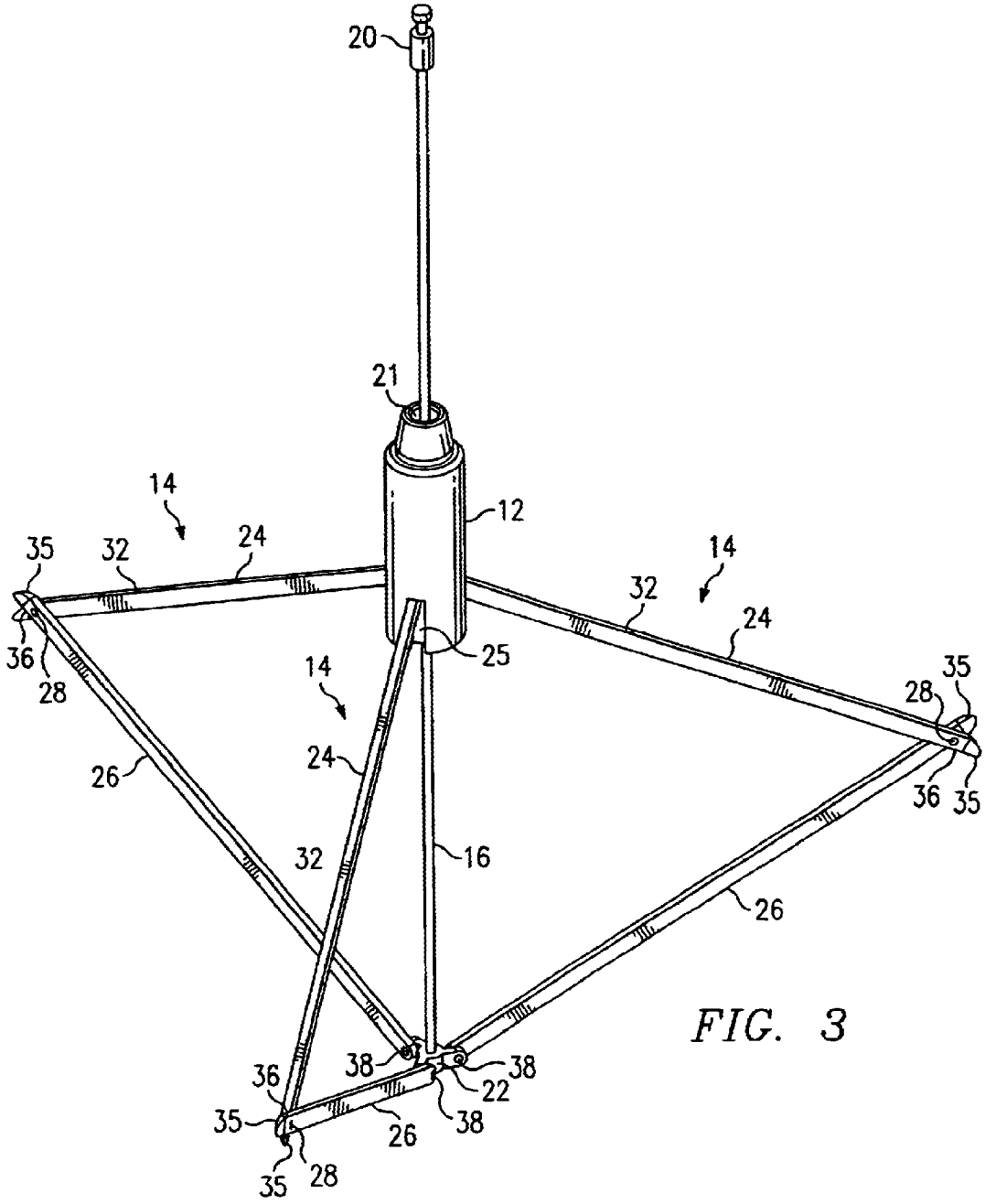
FIG. 3 is a diagram illustrating a pantograph underreamer in accordance with another embodiment of the present invention.

FIG. 3 is a diagram illustrating a pantograph underreamer in accordance with another embodiment of the present invention. In FIG. 3, underreamer 10 has three cutter sets 14. FIG. 3 also illustrates a connector 22 coupled to actuation rod 16. In this embodiment, second cutters 26 are coupled to connector 22 via pins 38; however, other suitable methods may be used to provide pivotal or rotational movement of second cutters 26.

Although the present invention has been described in detail, various changes and modifications may be suggested to one skilled in the art. It is intended that the present invention encompasses such changes and modifications as falling within the scope of the appended claims.

What is claimed is:

1. An underreamer for forming a cavity within a well bore, comprising:

a housing adapted to be rotatably positioned within the well bore;

an actuation rod slidably positioned in the housing;

at least one first cutter, each first cutter having a first end and a second end, each first end pivotally coupled to the housing; and at least one second cutter, each second cutter pivotally coupled to a respective first cutter, each second cutter having a first end and a second end, the first end of each second cutter pivotally coupled to the actuation rod, wherein an axial force applied to the actuation rod is operable to slide the actuation rod relative to the housing and extend the second ends of the first and second cutters radially outward relative to the housing from a retracted position to form the cavity when the housing is rotated relative to the well bore.

2. The underreamer of claim 1, wherein the first and second cutters are each disposed within an outwardly disposed recess of the housing when the first and second cutters are in a retracted position.

3. The underreamer of claim 1, wherein at least one of the first and second cutters comprises a replaceable tip at its second end, the replaceable tip extending past a point at which the first and second cutters are coupled.

4. The underreamer of claim 1, wherein each second cutter is pivotally coupled to a respective first cutter at the second end of the first cutter.

5. The underreamer of claim 1, wherein the underreamer comprises a central axis, and wherein the first ends of the first and second cutters are disposed substantially along the central axis.

6. The underreamer of claim 5, wherein the actuation rod extends from the housing to the first ends of the second cutters substantially along the central axis.

7. The underreamer of claim 1, wherein the actuation rod extends through an internal passage of the housing.

8. The underreamer of claim 1, further comprising a fishing neck coupled to the actuation rod, wherein the actuation rod is operable to receive an axial force via the fishing neck to provide the movement of the actuation rod relative to the housing.

9. The underreamer of claim 8, wherein the housing comprises an inwardly facing recess adapted to receive the fishing neck when the first and second cutters are in the retracted position.

10. The underreamer of claim 1, wherein the second ends of the first and second cutters extend radially outward relative to the housing when the axial force is applied to the actuation rod.

11. The underreamer of claim 10, wherein the second ends of the first and second cutters are operable to extend radially outward to a distance of between three to four feet relative to a central axis of the underreamer.

12. The underreamer of claim 1, further comprising a fishing neck coupled to the actuation rod and adapted to engage a fishing tool disposed within the well bore, the fishing neck disposed within an internal cavity of the housing when the first and second cutters are in the retracted position.

13. The underreamer of claim 1, wherein the actuation rod comprises a first end and a second end, the first end disposed proximate to the housing when the first and second cutters are in the retracted position.

14. A method for forming a cavity within a well bore, comprising:

positioning an underreamer within the well bore, the underreamer having a housing and an actuation rod, the actuation rod slidably positioned in the housing, the underreamer further having at least one first cutter and at least one second cutter, each of the first and second cutters having a first end and a second end, the first end of the first cutter coupled to the housing and the first end of the second cutter coupled to the actuation rod, the second end of the first cutter pivotally coupled to the second cutter proximate the second end of the second cutter;

applying an axial force to the actuation rod;

extending the first and second cutters radially outward from a retracted position relative to the housing in response to movement of the actuation rod relative to the housing from the applied force; and rotating the underreamer within the well bore to form the cavity.

15. The method of claim 14, wherein applying the axial force further comprises sliding the actuation rod through an internal passage of the housing.

16. The method of claim 14, further comprising extending a fishing tool into the well bore to engage a fishing neck coupled to the actuation rod, and wherein applying the axial force comprises applying the axial force to the fishing neck via the fishing tool.

17. The method of claim 14, wherein extending the cutters comprises extending the second ends of the first and second cutters radially outward relative to the housing.

18. The method of claim 14, wherein at least one of the first and second cutters comprises a replaceable tip at its second end, the replaceable tip extending past a point at which the first and second cutters are coupled.

19. The method of claim 14, wherein positioning the underreamer comprises positioning the underreamer having the first and second cutters each disposed within an outwardly disposed recess of the housing when the first and second cutters are in the retracted position.

20. The method of claim 14, wherein positioning the underreamer comprises positioning the underreamer having the first and second cutters, the second ends of the cutters pivotally coupled together and disposed substantially along a central axis of the underreamer.

21. The method of claim 20, wherein providing the underreamer comprises providing the underreamer having the actuation rod, the actuation rod extending substantially along the central axis.

* * * * *

UNITED STATES PATENT AND TRADEMARK OFFICE

CERTIFICATE OF CORRECTION

PATENT NO. : 6,644,422 B1
DATED : November 11, 2003
INVENTOR(S) : Monty H. Rial et al.

It is certified that error appears in the above-identified patent and that said Letters Patent is hereby corrected as shown below:

Title page,
Item [73], Assignee, after "CDX Gas, L.L.C.", delete "Richardson, TX" and insert -- Dallas, TX --.
Item [56], References Cited, U.S. PATENT DOCUMENTS, insert the following:

| | | | |
|---|---|---|---|
| -- 1,710,998 | 4/1929 | Rudkin | |
| 2,290,502 | 7/1942 | Squires | 255/76 |
| 3,126,065 | 3/1964 | Chadderdon | 175/269 |
| 3,339,647 | 9/1967 | Kammerer, Jr. | 175/268 |
| 4,887,668 | 12/1989 | Lynde, et al. | 166/55.8 |
| 5,392,862 | 2/1995 | Swearingen | 166/386 |

FOREIGN PATENT DOCUMENTS,

| | | |
|---|---|---|
| WO 01/83932A1 | 11/2001 | PCT |
| 1067819 | 12/1979 | Canada -- |

Signed and Sealed this

Eighth Day of June, 2004

JON W. DUDAS
*Acting Director of the United States Patent and Trademark Office*